US007260956B1

(12) United States Patent
Schabron et al.

(10) Patent No.: US 7,260,956 B1
(45) Date of Patent: Aug. 28, 2007

(54) SYSTEM FOR MAINTAINING MATERIALS AT FREEZER TEMPERATURES FOR SHIPPING

(75) Inventors: John F. Schabron, Laramie, WY (US); Susan S. Sorini-Wong, Laramie, WY (US)

(73) Assignee: The University of Wyoming Research Corporation, Laramie, WY (US)

( * ) Notice: Subject to any disclaimer, the term of this patent is extended or adjusted under 35 U.S.C. 154(b) by 246 days.

(21) Appl. No.: 11/167,992

(22) Filed: Jun. 27, 2005

Related U.S. Application Data

(60) Provisional application No. 60/583,177, filed on Jun. 25, 2004.

(51) Int. Cl.
*F25D 3/68* (2006.01)

(52) U.S. Cl. ..... 62/371; 62/457.2

(58) Field of Classification Search ..... 62/114, 62/371, 385, 457.2, 530; 252/62, 71
See application file for complete search history.

(56) References Cited

U.S. PATENT DOCUMENTS 5,650,090 A 7/1997 Salyer ..... 252/70
5,918,478 A * 7/1999 Bostic et al. ..... 62/371
5,924,302 A * 7/1999 Derifield ..... 62/457.2
6,209,343 B1 * 4/2001 Owen ..... 62/457.2
2003/0070436 A1 * 4/2003 Wood et al. ..... 62/114

OTHER PUBLICATIONS

"Blood Box: Battlefield Life Saver" Jun. 19, 2005, Kevin Diaz, Minneapolis-St. Paul Star Tribune, http://www.denver-rmn.com/shns/story.cfm?pk=BATTLEBLOOD-06-19-05&cat=AN.
"CRC Handbook of tables for Applied Engineering Science," 2nd Edition (1973), Ray E. Bolz and George L. Tuve Editors, CRC Press, Inc., Boca Raton, FL, Table 5-6.

* cited by examiner

*Primary Examiner*—Melvin Jones
(74) *Attorney, Agent, or Firm*—Santangelo Law Offices, P.C.

(57) ABSTRACT

At least one embodiment of the inventive technology relates to a frozen environmental sample temperature control system that comprises a frozen formulation having water in an amount from substantially 87% to 78% by weight of the formulation, and salt in an amount from substantially 13% to 22% by weight of the formulation, the system further including at least one container containing the frozen formulation; and a cooler having insulating material disposed between an outer wall and an inner surface that defines an inner chamber into which the at least one container and the at least one frozen environmental sample may be placed for storage and/or transport. Various embodiments may incorporate specific types of insulating material and/or adaptations to an inner surface of the cooler to enhance the insulation effected thereby.

42 Claims, 10 Drawing Sheets

SYSTEM FOR MAINTAINING MATERIALS AT FREEZER TEMPERATURES FOR SHIPPING

This is a United States non-provisional patent application and claims priority to U.S. Provisional Application No. 60/583,177, filed Jun. 25, 2004, hereby incorporated herein by reference. 7

GOVERNMENT LICENSE RIGHTS

This invention was made with Government support under Cooperative Agreement DE-FC26-98FT40322 awarded by the United States Department of Energy. The Government has certain rights in the invention. In particular, funding for this study was provided by the U.S. Department of Energy, Office of Fossil Energy, National Energy Technology Laboratory, Morgantown, Va. under Cooperative Agreement DE-FC26-98FT40322, Task 3.8. The U.S. Government has a paid-up license in this invention and the right in limited circumstances to require the patent owner to license others on reasonable terms as provided for by the terms of Cooperative Agreement DE-FC26-98FT40322, Task 3.8. awarded by The United States Department of Energy.

BACKGROUND OF THE INVENTION

Materials such as soil samples for volatile organic compound (VOC) analysis are usually shipped to a testing lab in coolers with ice packs such that they are kept at refrigerator temperatures near 4 C (+/−2 C). However, both the EPA and ASTM recognize the benefit of shipping samples at cooler temperatures—freezer (also known as freezing) temperatures (−7 to −17 C)—for preservation. Known systems for achieving such temperature control are often impractical or simply not feasible: shipping samples from the field in freezer compartments with electronic cooling devices powered by batteries is not feasible in most cases; shipping in coolers with dry ice is also not a viable option because air shipment of packages containing dry ice is regulated (dry ice sublimes to gaseous carbon dioxide, which can displace air in sealed aircraft). Also, dry ice has a temperature of −78 C, which is so cold that it will cause the seals of the sample containers to be compromised, and VOC's will be lost. Aspects of this inventive technology may resolve one or more of these problems through the use of a system that includes cooled packs of an aqueous solution of salt in combination with a cooler that may be adapted to enhance thermal insulation of enclosed contents. Some aspects may be directed to a novel water/salt solution alone.

BRIEF SUMMARY OF INVENTION

At least one embodiment of the inventive technology relates to a frozen environmental sample temperature control system that comprises a frozen formulation (e.g., a solution) having water in an amount from substantially 87% to 78% by weight of the formulation, and salt in an amount from substantially 13% to 22% by weight of the formulation, the system further including at least one container containing the frozen formulation; and a cooler having insulating material disposed between an outer wall and an inner surface that defines an inner chamber into which the at least one container and the at least one frozen environmental sample may be placed for storage and/or transport. In various embodiments, the insulating material may comprise a silica based insulating material, the inner surface may be configured to reduce conductive heat transfer to frozen contents of the cooler that are adjacent the inner surface, the insulating material may comprise a closed cell polymeric foam with a foam void volume to total foam volume ratio of greater than substantially 94%, and/or the insulating material may comprise an polymeric network with evacuated cells.

BRIEF DESCRIPTION OF DRAWINGS

FIG. 1*b* shows a frozen environmental sample (in a first type of sample container) whose temperature is to be controlled in at least one embodiment of the inventive technology.

FIG. 1*c* shows a frozen environmental sample (in a second type of sample container) whose temperature is to be controlled in at least one embodiment of the inventive technology.

DETAILED DESCRIPTION OF THE INVENTION

Figure 1:
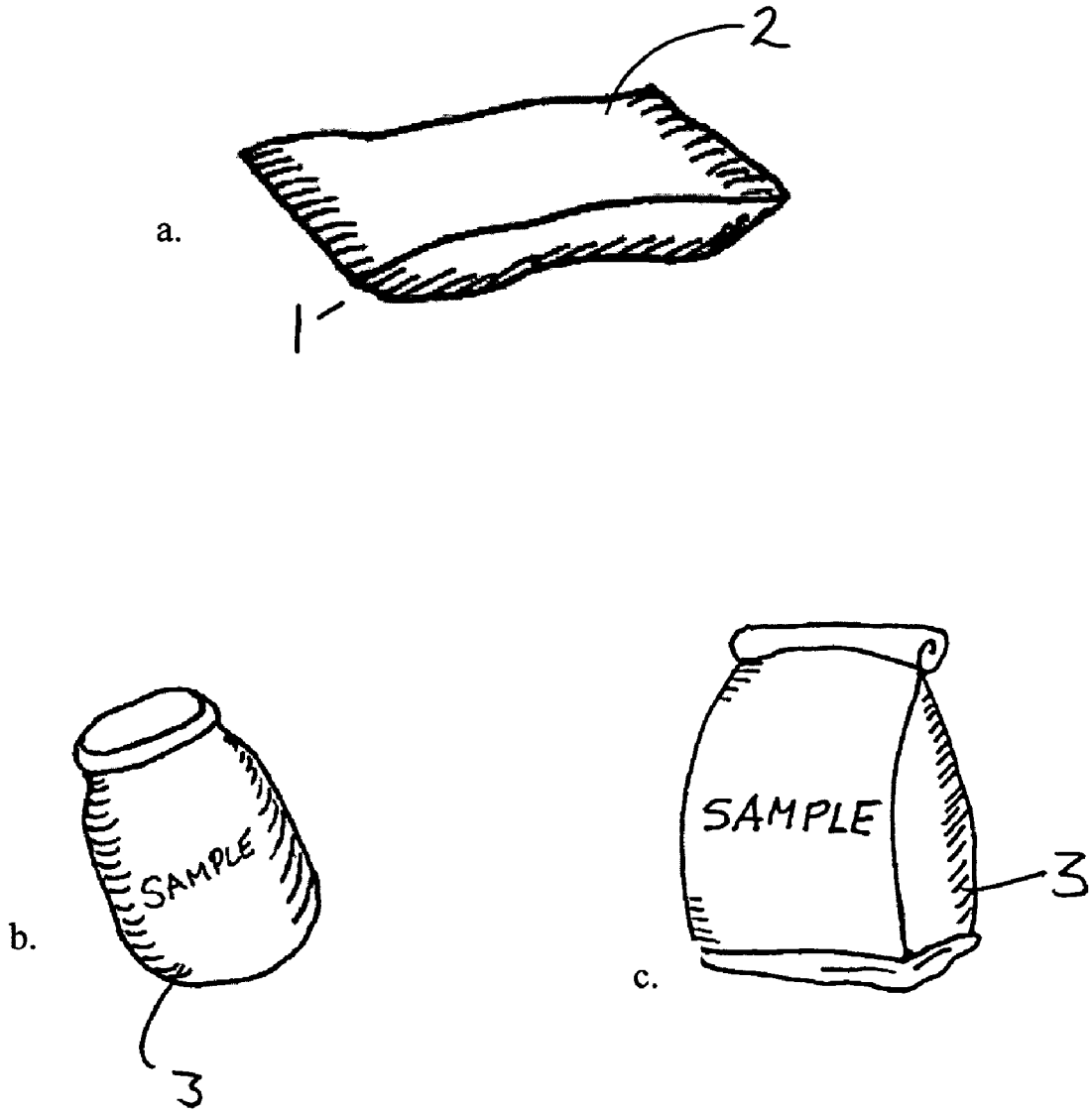
FIG. 1 a shows a container containing therein an aqueous solution as in at least one embodiment of the inventive technology.
Figure 2:
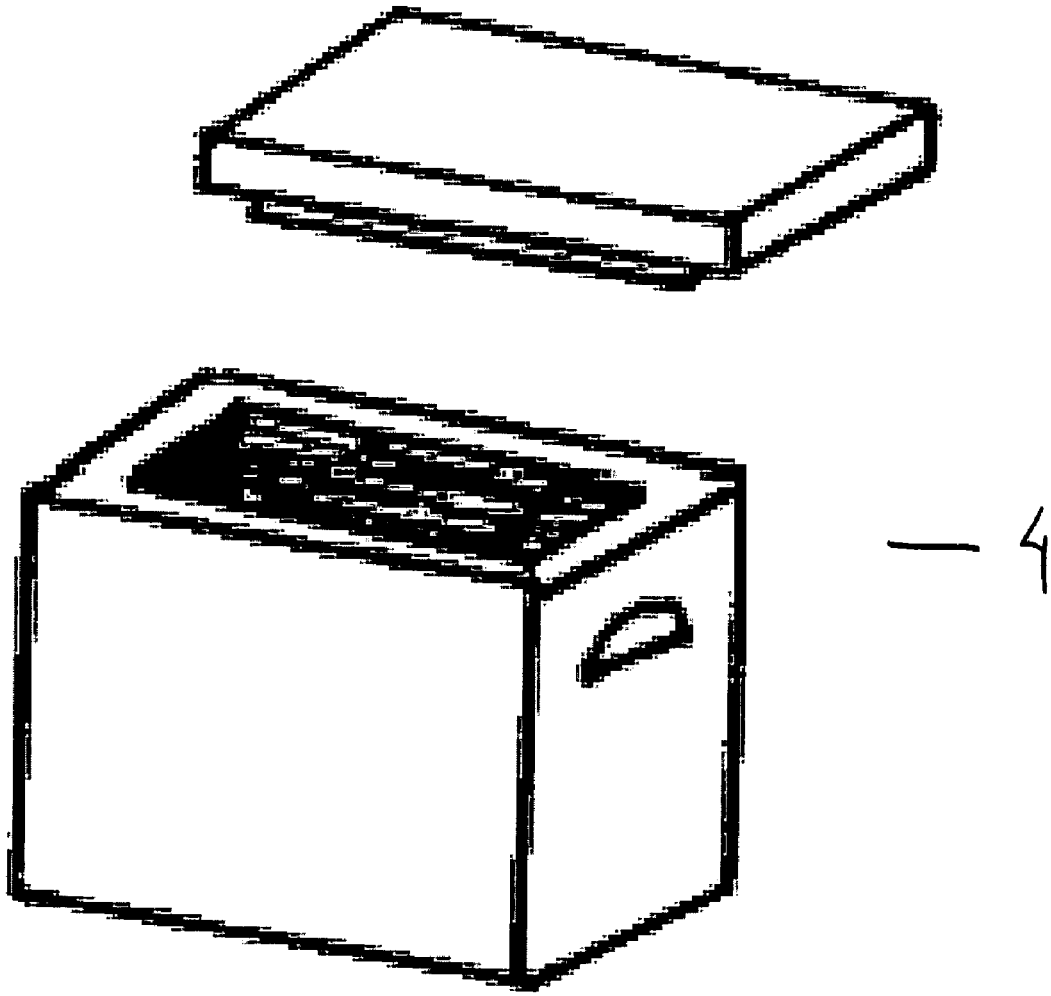
FIG. 2 shows a cooler that may be used in at least one embodiment of the inventive technology.

The present invention includes a variety of aspects, which may be combined in different ways. The following descriptions are provided to list elements and describe some of the embodiments of the present invention. These elements are listed with initial embodiments, however it should be understood that they may be combined in any manner and in any number to create additional embodiments. The variously described examples and preferred embodiments should not be construed to limit the present invention to only the explicitly described systems, techniques, and applications. Further, this description should further be understood to support and encompass descriptions and claims of all the various embodiments, systems, techniques, methods, devices, and applications with any number of the disclosed elements, with each element alone, and also with any and all various permutations and combinations of all elements in this or any subsequent application.

A wide variety of potential PCL formulations was evaluated by differential scanning calorimetry (DSC). The optimal PCL formulation 2 may comprise an aqueous solution of NaCl at a concentrations of substantially 17 wt. % (where substantially indicates a tolerance of +/−1.5%); formulations may be without KCl and/or a thickener (e.g., a polymeric thickener). Other inventive formulations may include KCl and/or thickener. KCl may be added to an aqueous solution of NaCl solutions to further depress the melting point, but at the sometimes unacceptable cost of lowering the heat of fusion. The formulation can be thickened using, e.g., a hydrolyzed cellulose (such as CMC) or acrylate water soluble polymer suitable for thickening the liquid at polymer concentrations up to 10 wt. %, although a preferred formulation includes neither thickener nor any salt other than NaCl. In embodiments that include a cooler, the formulation may have a concentration ranging from 15-22 wt. % (as but one of many possible ranges).

Work was performed to develop a new shipping system for frozen samples 3 (or other materials) that uses an optimal phase change liquid (PCL) freezer bag formulation and an insulated shipping container, perhaps with an on-board digital temperature data logger to provide a history of the temperature profile within the container during shipment. At least some of this work is presented in Exhibit A, hereby incorporated herein by reference.

At least one embodiment of the inventive technology may be a frozen environmental sample temperature control system having a frozen formulation that may comprise water (e.g., distilled and/or deionized water) in an amount from substantially 87% to 78% by weight of the formulation, and salt in an amount from substantially 13% to 22% by weight of the formulation. The system may further comprise at least one container 1 containing the frozen formulation and a cooler 4 having insulating material 5 disposed between an outer wall and an inner surface 6 that defines an inner chamber 7. The inner chamber may be sized to contain in it the at least one container and at least one frozen environmental sample for transport and/or storage. In a preferred embodiment, the insulating material entirely surrounds the inner surface when the cooler is closed during shipping. In embodiments where there is only salt and water in the formulation, it is preferred, but not required, that the salt be sodium chloride (NaCl), but other salts may indeed be within the scope of the inventive technology. Also, it should be noted that in preferred embodiments (but certainly not in all embodiments), the per-centage amounts of the salt and of water total 100 per-cent.

It should be understood that the term temperature control system is a broad term that refers to at least two types of systems—a storage system and a shipping system. Of course, where the temperature control system is intended to control the temperature of a cooled material such as a frozen environmental sample, the system is a frozen environmental sample temperature control system; in broader applications, the system may be a frozen material temperature control system. As the term frozen refers to a material (such as an environmental sample) exhibiting temperatures with the range of from −7-−17 degrees C. inclusive (freezing temperatures), a frozen material temperature control system has as a goal the maintenance of the material within the freezing temperature range for a certain period of time. In material shipping systems, that certain period of time is, in some embodiments, the expected time from initial packing of the cooler with the material and the cooled containers of formulation, to the time of receipt by an intended recipient (e.g., a lab technician), such as 12 or 14 hours (as but merely two of many examples).

As to protocol relative to use of the system, typically the materials whose temperature is to be controlled are pre-cooled, meaning cooled to below ambient temperature, such as to within the intended temperature range before the materials are placed into the cooler with the cooled formulation. However, the inventive technology also covers use of the cooled formulation and cooler to bring materials with a temperature above the intended range (freezing temperatures or refrigerator temperatures, as but two examples) to within the desired range. It is further pointed out that although typical protocol does not involve pre-cooling the cooler (e.g., before materials and cooled formulation is placed therein), embodiments of the inventive technology may certainly also include such method. As the reader has likely inferred, the term cooled may refer simply to material whose temperature has been reduced to below that value the material would otherwise have (e.g., if left in ambient temperatures such as room temperature). Cooled temperatures include freezing temperatures and refrigerator temperatures, as but two examples of temperature ranges of cooled materials.

In certain embodiments of the inventive technology, the inner surface of the cooler—whether part of the insulating material or instead part of an inner wall that is distinct from the insulating material—may be configured to reduce conductive heat transfer to frozen contents of said cooler that are adjacent said inner surface. In such embodiments, the inner surface may be ribbed, pointed (the "point" need not be sharp and can instead be rounded), holed, or woven, as but a few examples, in order to reduce conductive heat transfer to contents (e.g., frozen environmental samples and bags of frozen formulation) by, e.g., reducing the surface area of direct contact between the inner surface of the cooler and contents of the cooler that contact the inner surface. In certain embodiments of the inventive technology, the inner surface may be reflective.

Figure 3:
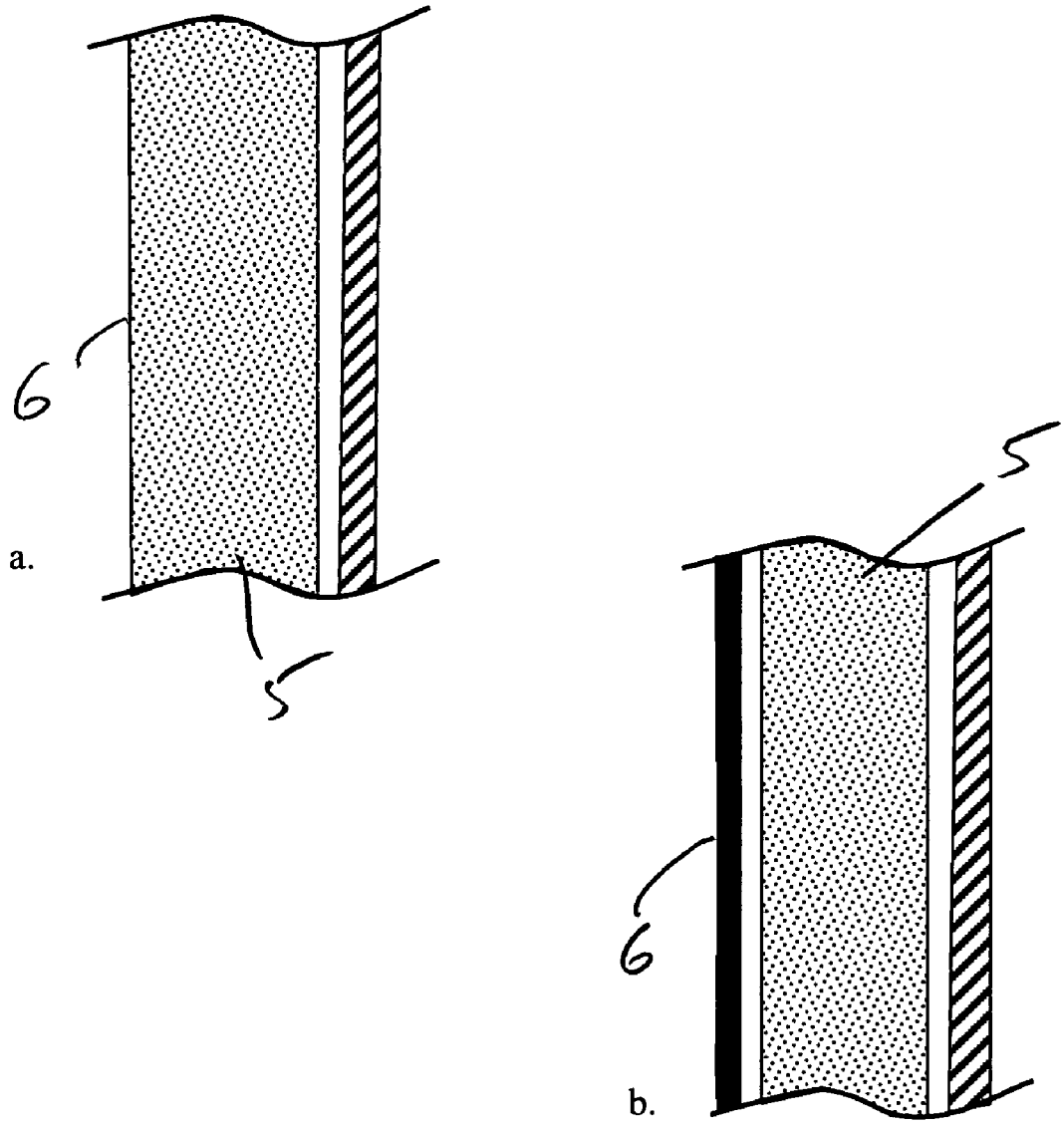
FIG. 3*a* shows a cross-sectional view of a portion of a cooler that may be used in at least one embodiment of the inventive technology.
FIG. 3*b* shows a cross-sectional view of a portion of a cooler that may be used in at least one embodiment of the inventive technology.

In those embodiments having an inner wall (which, by definition, is distinct from an inner part of the insulating material proximate the inner wall) as in FIG. 3*b*, for example, the inner wall may be configured so as to have a reduced heat storage capacity as compared with the heat storage capacity of inner walls of coolers conventionally used to transport cooled environmental samples. Such reduction in heat storage capacity may be achieved by reducing the mass of the inner wall by, e.g., reducing the thickness of the inner wall, eliminating it, and/or making it from materials that are less dense (e.g., polymeric foam).

In certain embodiments, the insulating material may comprise a silica based insulating material such as aerogel. In certain embodiments, the insulating material may comprise a closed cell polymeric foam with a foam void volume to total foam volume ratio of greater than substantially 94%, greater than substantially 96%, or greater than substantially 97%; in some embodiments, the closed cell polymeric foam may comprise a thermosetting foam, a thermoplastic foam, or an elastomeric foam. Under another system of classification, the foam may comprise polystyrene foam, polyurethane foam, ABS foam, ethylene vinyl acetate foam, polyethylene foam or polypropylene foam. The cells themselves may encapsulate either a gas (e.g., air, nitrogen, argon, helium) or a vacuum (i.e., evacuated cells).

Figure 10:
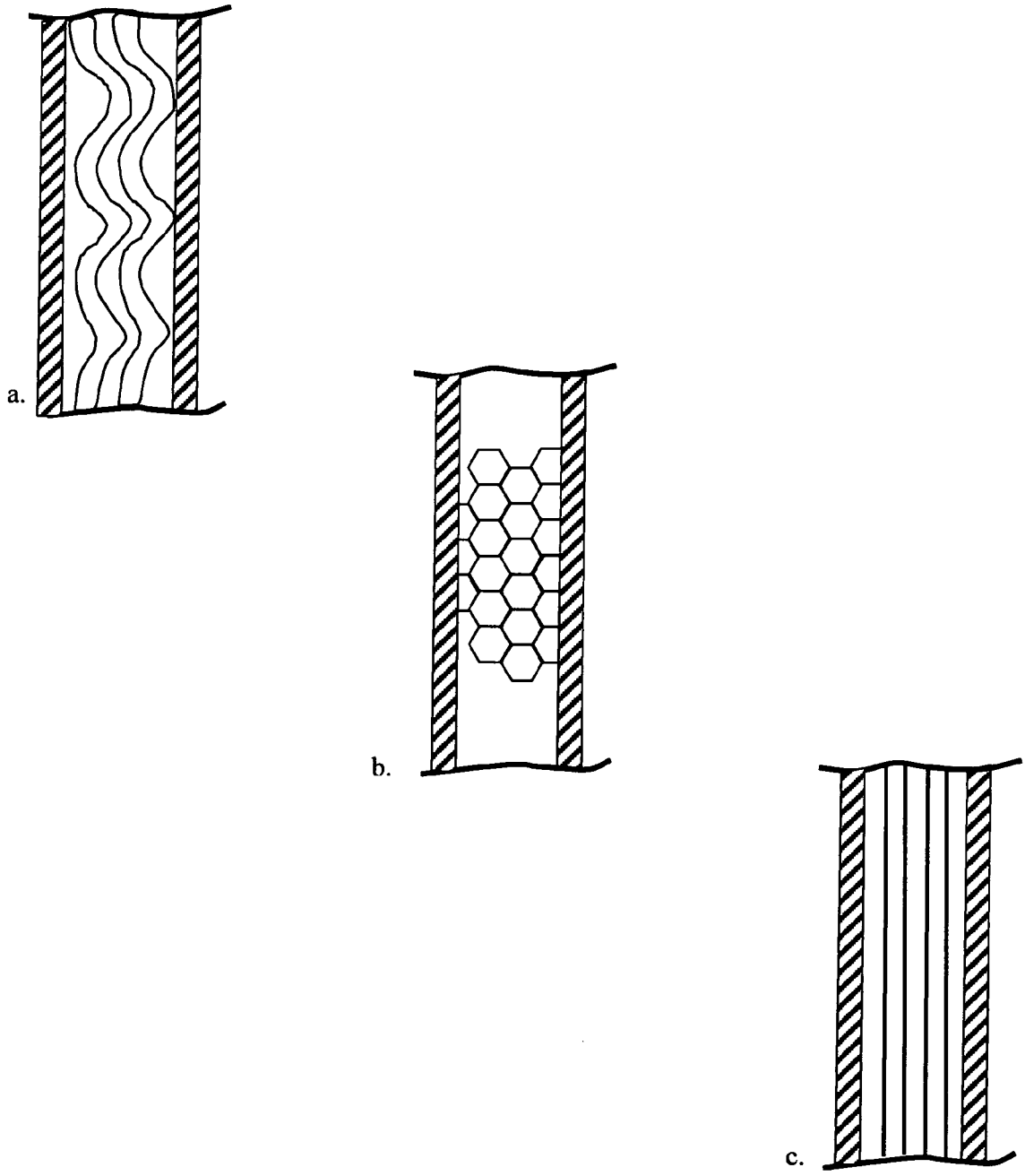
FIG. 10*a* shows a cross-sectional view of a portion of a cooler having a ribbed polymeric network with evacuated cells as insulating material.
FIG. 10*b* shows cross-sectional top view of a portion of a cooler having a honeycomb polymeric network with evacuated cells as insulating material.
FIG. 10*c* shows a cross-sectional view of a portion of a cooler having a strutted polymeric network with evacuated cells as insulating material.

In certain embodiments, the insulating material may comprise an polymeric network (e.g., foam, struts as in FIG. 10*c*, ribbing as in FIG. 10*a*, honeycomb as in FIG. 10*b*) with evacuated cells. Where such cells are open, the vacuum established in the network may indeed be lost after a certain amount of time, but that amount of time may be greater than the length of time the insulating effect of the cooler is needed (e.g., less than 12 hours in the case of some overnight shipments). The term cell is a broad term, and certainly not limited to the small cells found typically found in foams. Indeed, the cells can be large (e.g., as found in strutted, ribbed, or honeycomb networks). In certain embodiments, the network void volume to total network volume ratio may be greater than substantially 94%; in some embodiments, the open cell polymeric network may comprise a thermoplastic polymeric network (e.g., a thermoplastic polymeric foam), an elastomeric network (e.g., an elastomeric foam), or a thermosetting polymeric network (e.g., a thermosetting foam). Under another system of classification, an open cell network may comprise polystyrene network (e.g., polystyrene foam), polyurethane network (e.g., polyurethane foam), ABS network (e.g., ABS foam), ethylene vinyl acetate network (e.g., ethylene vinyl acetate foam), polyethylene network (e.g., polyethylene foam) or polypropylene network (e.g., polypropylene foam). Related systems may incorporate a pump (e.g., a hand pump or electric pump) by which to impart a vacuum to the network, where, as in the case of open celled networks, such vacuum is lost over time.

At least one embodiment of the inventive technology may be a frozen environmental sample temperature control solution that comprises salt; and liquid water in which the salt is dissolved to form a formulation, where the formulation has a heat of fusion in calories per gram that is at least 80% the heat of fusion of water, a unimodal melting point, and comprises substantially from 15% by weight of salt to substantially 20% by weight of salt.

It should be noted that the term salt may be either one or a plurality of salts. In a preferred embodiment, however, it relates to one type of salt—NaCl. However, in some embodiments, the system may include KCl, whether exclusively or in combination with NaCl. Further, although in a preferred embodiment of the inventive technology the formulation does not include thickener (e.g., a polymeric thickener added to facilitate handling of the contained formulation), certain embodiments may include thickener (Instathick, as but one example). In a preferred embodiment, the system includes a salt concentration of substantially 17% by weight and substantially 83% by weight of the formulation (where substantially implies a tolerance of +/−1½%). However, certainly other ranges are included within the scope of the inventive technology.

In certain embodiments of the inventive technology, the insulating material has a thickness that is greater (e.g., at least 10% greater) than that of currently available foam insulating coolers used for shipping of refrigerator temperature environment samples. Of course, the thickness of the insulating material must be sufficient to keep the temperature of the materials whose temperature is to be controlled above the highest acceptable temperature upon their removal from the cooler (given the constraints of the cooling problem (e.g., the expected external profile, the initial temperature of the materials whose temperature is to be controlled, the extent to which the available space in the cooler other than the materials whose temperature is to be controlled is filled with cooled formulation, the temperature above which materials must be upon their removal from the cooler, etc.)

It should be noted that in a preferred embodiment, an aqueous solution of a salt implies the addition of that salt to salt free water (e.g., water that has no or only de minimus amounts of salt, such as distilled, deionized water). However, embodiments of the invention are intended to involve aqueous solutions of a salt, regardless of whether that salt was added or is naturally occurring, e.g.). Any manner of dissolution (as but one example, mechanical) may be used to dissolve the added salt in the water (e.g., distilled, deionized water).

At least one embodiment of the invention may relate to the use of NaCl in aqueous solution (where this solution might not also have a second added salt in non-negligible amount dissolved therein) in an amount that maximizes the reduction in melting point (relative to that melting point that would be observed if there were no salt dissolved therein). This maximization in reduction of melting point may be achieved without also causing a bimodal melting point profile (or without unacceptably diverging peaks of an existing bimodal melting point profile). At least one embodiment of the invention may involve the use of NaCl in aqueous solution in that amount (e.g., 17 wt. % NaCl, or other values as reflected by the tables filed herewith) that effects a substantial convergence to a single peak of an otherwise substantially bi-modal melting point profile. At least one embodiment of the invention may be the use of that amount by wt. % of NaCl in aqueous solution that minimizes the difference between the temperature of melting onset and the temperature of melting peak.

It should be understood that embodiments of the inventive technology may find application not only to the cooling of soil samples for volatile organic compound (VOC) analysis, but also for the cooling of any material of which cooling/refrigeration may be desired or required. Indeed, freezing of the sample is not mandatory, as it may be that some materials that are to be cooled using the frozen solution may have a lower freezing point than the coldest temperature reached by the frozen solution. Cooling is a broad term and includes generally the reduction of temperature of a given substance (e.g., a soil sample for VOC analysis) relative to that temperature that the substance would reach in the absence of such cooling. Thus, even a sample whose temperature has increased over a period of time may be cooled.

In addition to the temperature of fusion, in some embodiments, the heat of fusion may be an important parameter. The higher the heat of fusion, the greater the capacity for the material to store or release energy at the temperature of fusion. The heat of fusion of water is near 80 cal/g (Bolz and Tuve 1980). Ideally, a formulation will have as large a heat of fusion as possible, although embodiments of the inventive technology may indeed include solutions whose heat of fusion is sub-maximal, but whose temperature of fusion renders the solution attractive for a given application. What may also render a formulation attractive for a certain application may be an enhanced ability to control temperature of a material due to a formulation's unimodal melting point profile. A bimodal melting point is deemed to exist where the melting point profile exhibits more than one zero slope.

Adding chemicals (including salts) to water can have the desired effect of lowering the freeze point, but also the undesired effect of decreasing the heat of fusion. In at least one embodiment of the invention, the optimal formulation, therefore, will lower the freeze point to the desired temperature range while maintaining a heat of fusion as close to that of water as possible. Indeed, relative to at least one embodiment of the invention, the inventors contemplate consideration of each the heat of fusion and the temperature of fusion (and perhaps also the formulation's melting point temperature profile) in the determination of appropriate quantities of salt (e.g., NaCl) in aqueous solution.

At least one embodiment of the inventive technology may relate to a frozen environmental sample shipping system. It may incorporate aspects of the formulation and/or the cooler. In certain embodiments, the cooler may have inner walls whose total mass is less than that mass of the inner walls of the foam-filled polyethylene coolers (such as Coleman™ coolers and other brands) that are commonly used for shipping of environmental samples with water-containing ice bags to maintain them at refrigeration temperatures (+4±2° C.). Although these coolers perform adequately for shipping samples at refrigeration temperature, there is too much heat transfer when frozen materials (at −12±5° C.) are shipped with the intent of keeping the temperature of the frozen materials above the upper end of this range (−7° C.) for a sufficiently long periods of time (e.g., 12 hours for overnight shipping). Such types of prior art coolers have not been designed to maintain materials at freezer temperatures for adequate periods of time. For example, heat can enter the cooler through the outer polyethylene wall to the inner polyethythnlene wall by conduction through the polyethylene material directly (in those conventionally used coolers having gaps in the insulation). This mechanism is not slowed down by the foam filling that is found between the inner and outer walls.

In addition, the polyethylene inner walls of conventionally used coolers are relatively thick and store a significant amount of heat. When cooler material is put into a cooler that has been stored at ambient temperature (the typical practice in shipping environment samples), heat from the warmer walls is transferred to the cooler material. This can affect the ability of a frozen phase change liquid to maintain the contents at freezer temperatures (−12±5° C.) for an adequate period of time. In some embodiments, the inner walls may be made of a thinner polyethylene material with less mass and heat storage capacity than is found in current designs, or be constructed from other polymeric material to provide less mass and heat storage capacity, or even other materials with less total heat storage properties (including but not limited to: wood, aluminum alloys, and reflective metallized plastic film). In some embodiments, walls that are less dense (yet still sufficiently strong for their intended purposes) may introduce into the cooler less mass that can store heat and transfer it to the cooled contents upon their initial placement in the uncooled cooler. The inventors of this technology have determined that, indeed, one source of the problem associated with the use of conventional coolers to maintain materials at freezing temperatures for a certain period of time is the excessively high heat storage capacity of inner walls of conventional coolers that are not pre-cooled and that are used to ship cooled materials (e.g., environmental samples) to arrive within the freezing temperature range. It should be noted that, although typically materials are frozen before placement into a cooler, aspects of the inventive technology also cover the case where the contained frozen formulation placed in the cooler with the materials whose temperature is to be controlled is used to cool materials to within the frozen temperature range.

Figure 4:
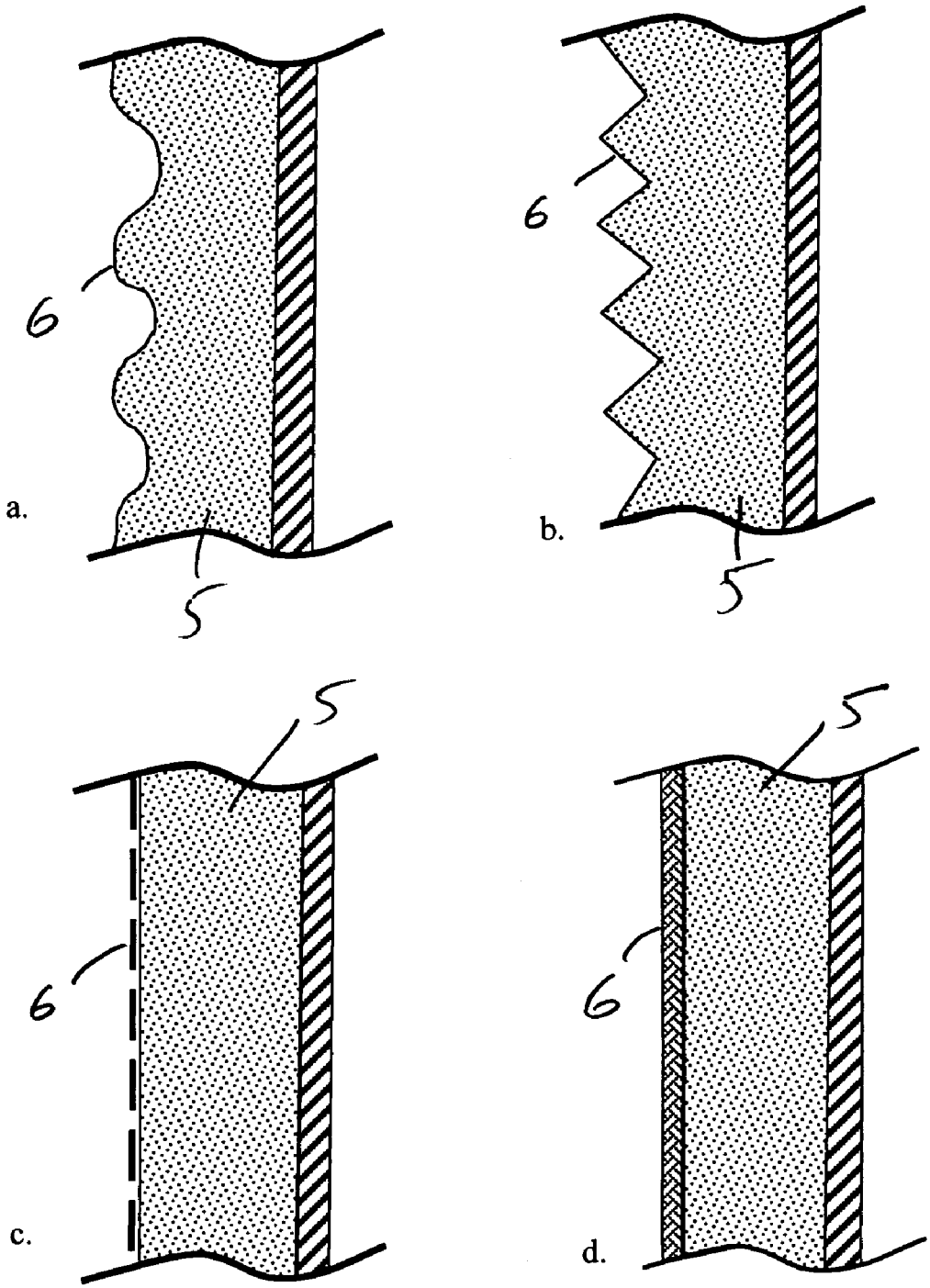
FIG. 4*a* shows a cross-sectional view of a portion of a cooler that may be used in at least one embodiment of the inventive technology.
FIG. 4*b* shows a cross-sectional view of a portion of a cooler that may be used in at least one embodiment of the inventive technology.
FIG. 4*c* shows a cross-sectional view of a portion of a cooler that may be used in at least one embodiment of the inventive technology.
FIG. 4*d* shows a cross-sectional view of a portion of a cooler that may be used in at least one embodiment of the inventive technology.
Figure 5:
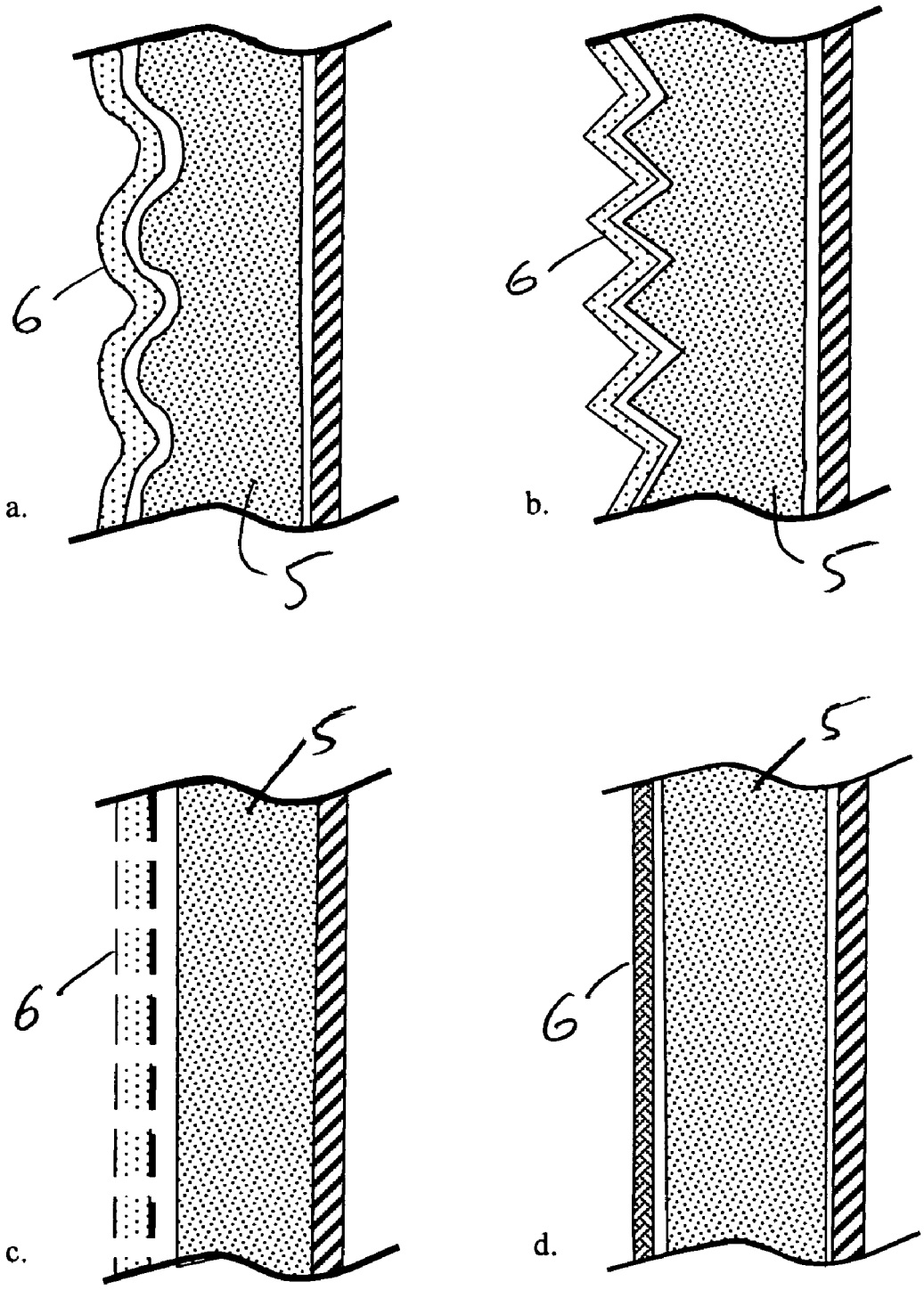
FIG. 5*a* shows a cross-sectional view of a portion of a cooler that may be used in at least one embodiment of the inventive technology.
FIG. 5*b* shows a cross-sectional view of a portion of a cooler that may be used in at least one embodiment of the inventive technology.
FIG. 5*c* shows a cross-sectional view of a portion of a cooler that may be used in at least one embodiment of the inventive technology.
FIG. 5*d* shows a cross-sectional view of a portion of a cooler that may be used in at least one embodiment of the inventive technology.
Figure 6:
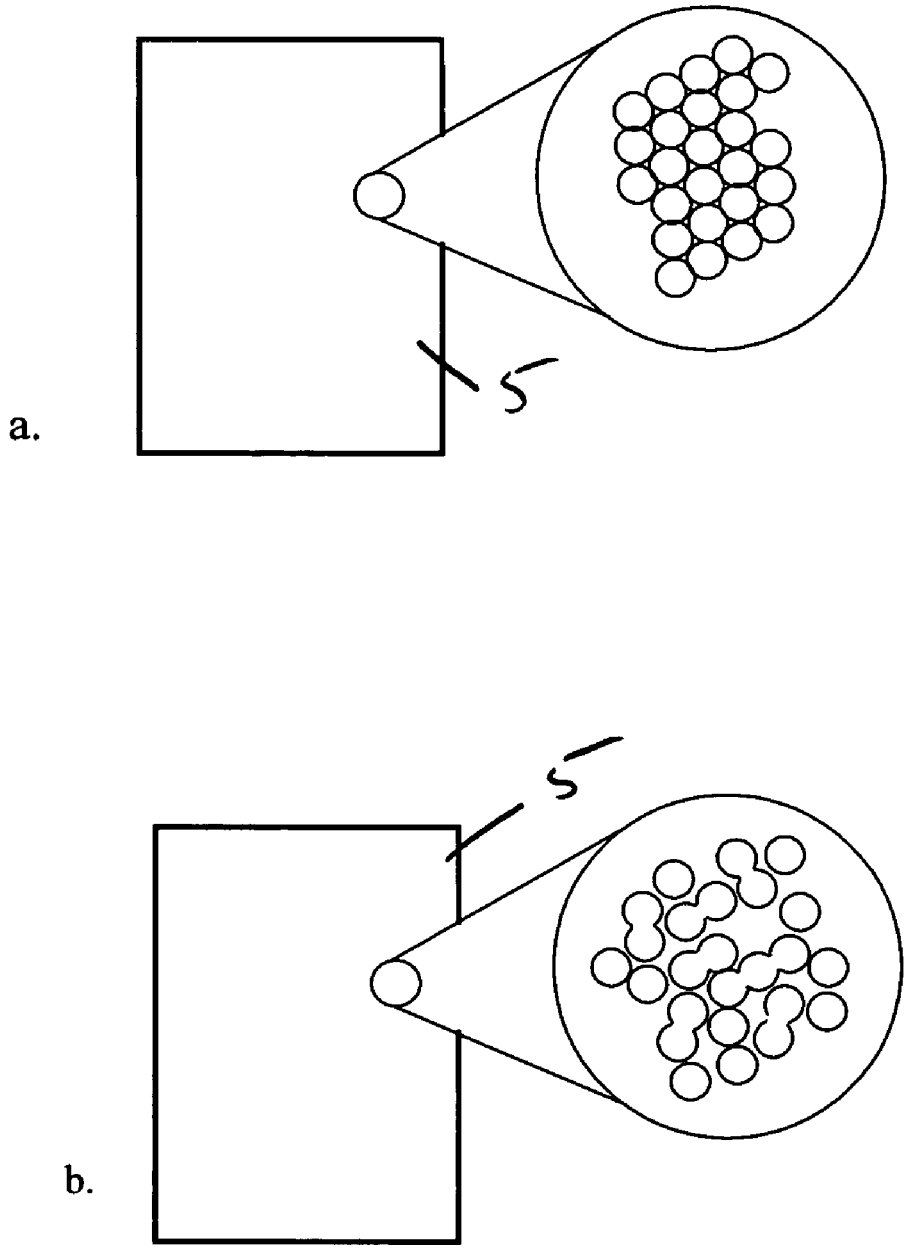
FIG. 6*a* shows a magnified view of a section of closed-cell foam used for the insulating material of a cooler used in at least one embodiment of the inventive technology.
FIG. 6*b* shows a magnified view of a section of open-cell foam used for the insulating material of a cooler used in at least one embodiment of the inventive technology.
Figure 7:
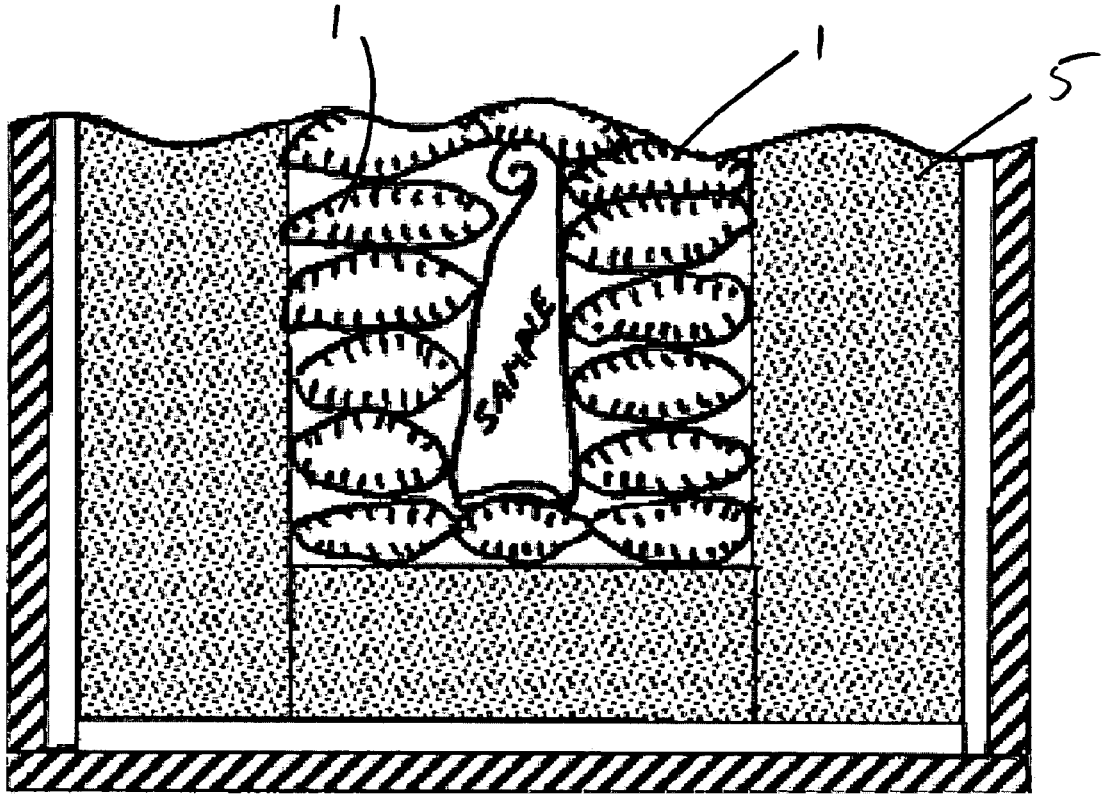
FIG. 7 shows a cross-sectional view of containers containing frozen formulation, a sample, and a cooler as found in at least one embodiment of the inventive technology.
Figure 8:
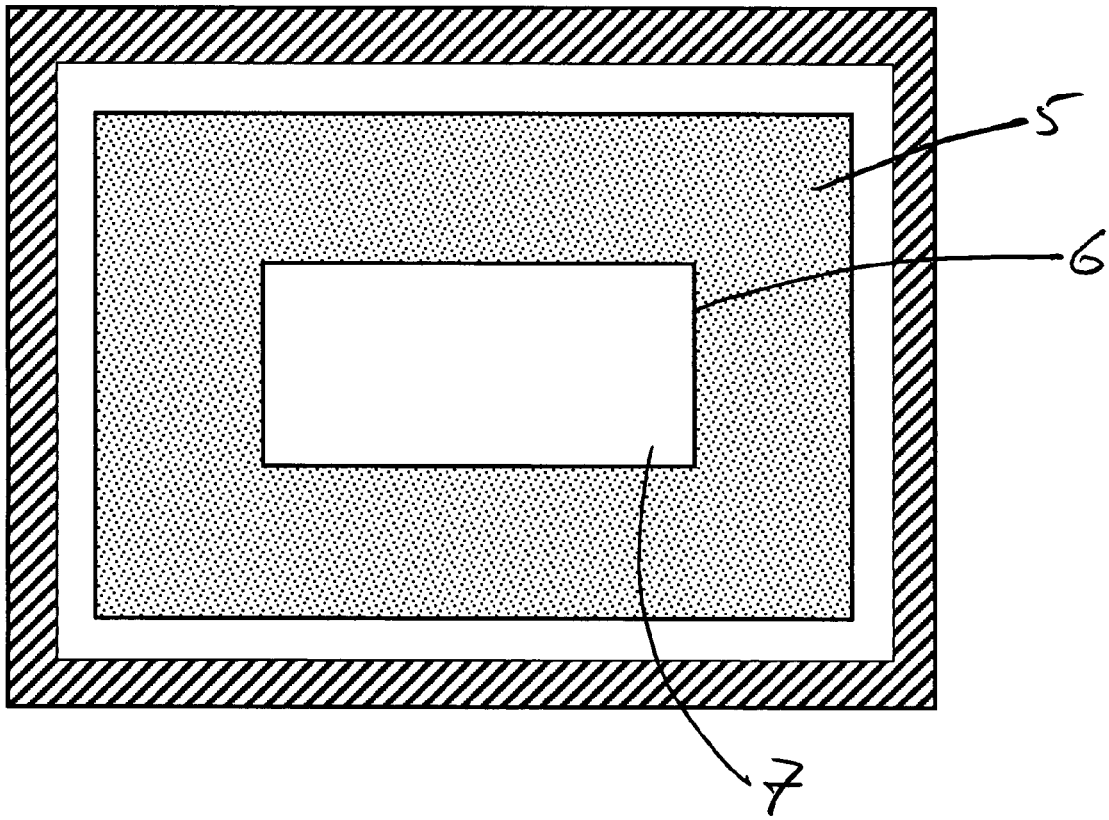
FIG. 8 shows a plan view of a horizontal cross-section of a cooler in at least one embodiment of the inventive technology.
Figure 9:
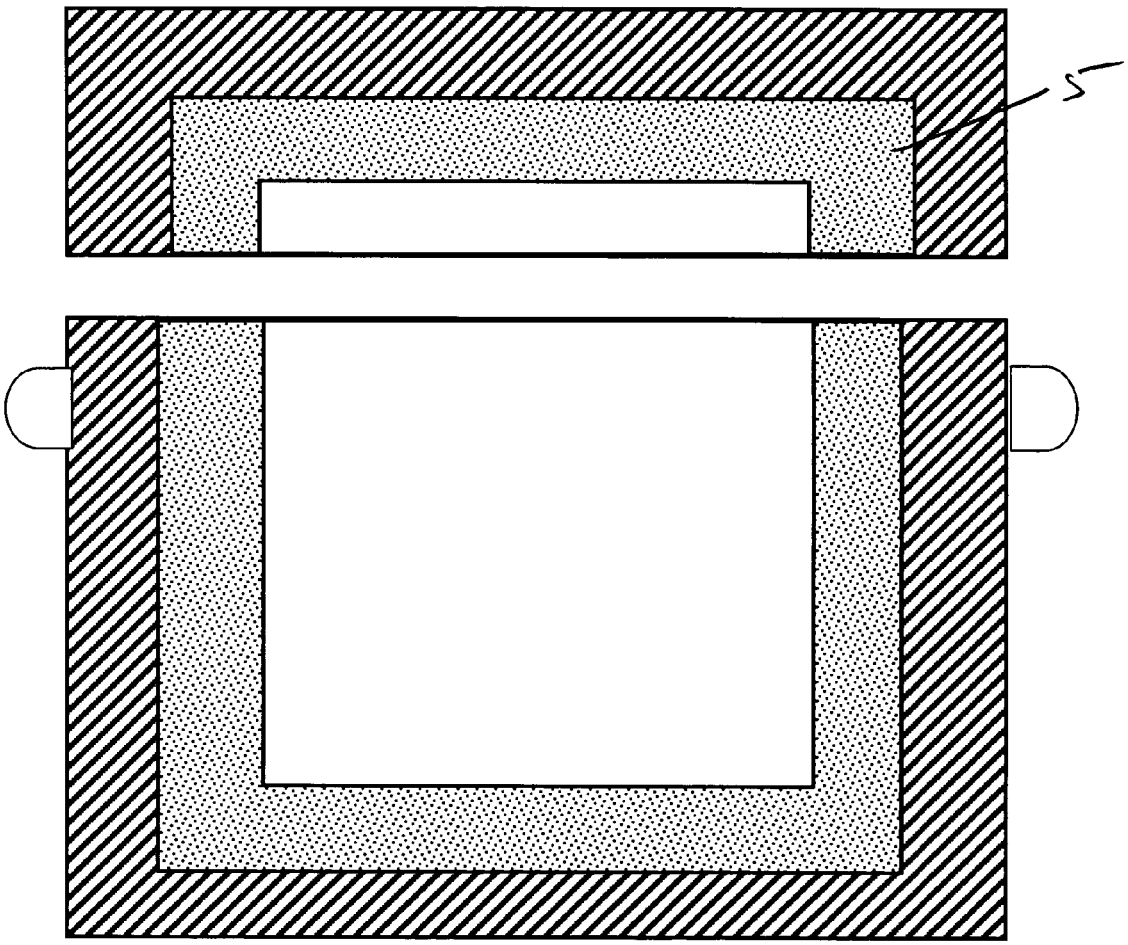
FIG. 9 shows a view of a vertical cross-section of a cooler used in at least one embodiment of the inventive technology.

In addition to (or instead of) having inner walls that have a reduced heat storage capacity as compared with existing coolers, the inner surface walls may be ribbed, pointed, woven (see FIGS. 4*d* and 5*d*), and/or have holes in them, to effect enhanced cooling by reducing direct contact between the inner walls of the cooler with the frozen material to decrease the rate of heat transfer from an un-cooled cooler inner surface to frozen materials that contact that inner surface (e.g., frozen bags) upon their initial placement into the "warm" cooler. It should also be noted that the inner surface so configured may be part of an inner wall (e.g., an inner cooler wall) that is distinct from the insulating material (although indeed it may directly contact it), or the inner surface so configured may be the inner surface of the insulating material (e.g., in those embodiments where there is no inner wall distinct from the insulating material).

Coolers whose inner surfaces are ribbed (e.g., FIGS. 4*a* and 5*a*), pointed (e.g., FIGS. 4*b* and 5*b*) and/or are "holed" (e.g., FIGS. 4*c* and 5*c*) can reduce the heat transfer rate to the cooled contents merely by reducing the direct contact between the cooled contents and the inner walls of the cooler, even where the materials used for the inner walls are identical in type and total mass to those of conventional coolers. It should be noted that an ideal system may indeed include not only inner walls having inner surfaces that are configured to reduce conductive heat transfer to contacting frozen contents (e.g., by being configured to be pointed, ribbed, woven, or "holed"), but also may have inner walls that have a reduced mass (as compared with those of conventionally used polyethylene insulating coolers).

Of course, externally of the inner chamber and internally of the exterior walls of the cooler is some type of insulation material. Such materials include but are not limited to aerogel, polystyrene foam and polyurethane foam. They include any materials that have an improved insulating effect as compared with the current typical configuration of injected polyurethane foam between the polyethylene walls of conventional coolers, regardless of the reason for that improved insulating effect (such reasons including: additional foam thickness, more effective capture of gas or vacuum; lower density; and/or more structural "deadends" to terminate conduction in the foam supporting structure, as but three examples). In one embodiment, as mentioned, the insulating material may comprise silica aerogel. Such aerogel may or may not be combined with another material (e.g., carbon black and/or a reinforcing material such as reinforcing fiber, as but a few examples).

In certain embodiments (e.g., those that incorporate the cooler), the formulation may be from 13%-22% by weight salt in water (e.g., one salt, such as NaCl), and may or may not include a thickener (e.g., a polymer). However, the optimal, cooler-based system may indeed use the preferred embodiment of the formulation (i.e., one having substantially 83% by weight water (e.g., distilled, deionized water) and substantially 17% by weight salt such as NaCl). Ranges for salt content (e.g., NaCl) of the formulation in the cooler-based system include but are not limited to: 13%-22% by weight salt, 14%-21% by weight salt, 15%-20% by weight salt, and 16%-19% by weight salt. Again, such formulations may or may not comprise a thickener, although in a preferred embodiment, the inventive technology does not. Further, they may include more than one salt (e.g., NaCl and KCl), although in a preferred embodiment, only one salt (e.g., NaCl) is used.

Although indeed, in some embodiments, the technology may achieve enhanced cooling through the combined effect of the cooler and the formulation, an on-board temperature data logger may be part of the system and play an important role in tracking the thermal history of the sample, assessing the representative nature of the sample, and assessing the need to make changes to the system (whether to enhance cooling in the case where sample(s) arrived at a high temperature, or to moderate the cooling effect—thereby possibly saving costs—in the case where sample(s) arrived at an unnecessarily low temperature).

It should be noted that a goal of at least one embodiment of the inventive technology is to include as part of the system enough frozen formulation and enough insulating effect that, when combined, result in a cooler-contained environmental sample(s) that is delivered at or below a certain temperature to an intended recipient at or before an estimated time. In those embodiments in which economy may be an important objective, a goal may be to have no more than that amount of bags, and no more than that amount of insulating material that, given other constraints of the application (e.g., expected ambient heat during travel, expected time of travel, heat carrying capacity of internal walls of the cooler), result in a cooling system that does not have more materials (e.g., formulation and insulating) than is necessary.

As can be easily understood from the foregoing, the basic concepts of the present invention may be embodied in a variety of ways. It involves both cooling techniques as well as devices to accomplish the appropriate cooling. In this application, the cooling techniques are disclosed as part of the results shown to be achieved by the various devices described and as steps which are inherent to utilization. They are simply the natural result of utilizing the devices as intended and described. In addition, while some devices are disclosed, it should be understood that these not only accomplish certain methods but also can be varied in a number of ways. Importantly, as to all of the foregoing, all of these facets should be understood to be encompassed by this disclosure.

The discussion included in this application is intended to serve as a basic description. The reader should be aware that the specific discussion may not explicitly describe all embodiments possible; many alternatives are implicit. It also may not fully explain the generic nature of the invention and may not explicitly show how each feature or element can actually be representative of a broader function or of a great variety of alternative or equivalent elements. Again, these are implicitly included in this disclosure. Where the invention is described in device-oriented terminology, each element of the device implicitly performs a function. Apparatus claims may not only be included for the device described, but also method or process claims may be included to address the functions the invention and each element performs. Neither the description nor the terminology is intended to limit the scope of the claims that will be included in any subsequent patent application.

It should also be understood that a variety of changes may be made without departing from the essence of the invention. Such changes are also implicitly included in the description. They still fall within the scope of this invention. A broad disclosure encompassing both the explicit embodiment(s) shown, the great variety of implicit alternative embodiments, and the broad methods or processes and the like are encompassed by this disclosure and may be relied upon when drafting the claims for any subsequent patent application. It should be understood that such language changes and broader or more detailed claiming may be accomplished at a later date (such as by any required deadline) or in the event the applicant subsequently seeks a patent filing based on this filing. With this understanding, the reader should be aware that this disclosure is to be understood to support any subsequently filed patent application that may seek examination of as broad a base of claims as deemed within the applicant's right and may be designed to yield a patent covering numerous aspects of the invention both independently and as an overall system.

Further, each of the various elements of the invention and claims may also be achieved in a variety of manners. Additionally, when used or implied, an element is to be understood as encompassing individual as well as plural structures that may or may not be physically connected. This disclosure should be understood to encompass each such variation, be it a variation of an embodiment of any apparatus embodiment, a method or process embodiment, or even merely a variation of any element of these. Particularly, it should be understood that as the disclosure relates to elements of the invention, the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled. As but one example, it should be understood that all actions may be expressed as a means for taking that action or as an element which causes that action. Similarly, each physical element disclosed should be understood to encompass a disclosure of the action which that physical element facilitates. Regarding this last aspect, as but one example, the disclosure of a "coolant" should be understood to encompass disclosure of the act of "cooling"—whether explicitly discussed or not—and, conversely, were there effectively disclosure of the act of "cooling", such a disclosure should be understood to encompass disclosure of a "coolant" and even a "means for cooling" Such changes and alternative terms are to be understood to be explicitly included in the description.

Any acts of law, statutes, regulations, or rules mentioned in this application for patent; or patents, publications, or other references mentioned in this application for patent are hereby incorporated by reference. In addition, as to each term used it should be understood that unless its utilization in this application is inconsistent with such interpretation, common dictionary definitions should be understood as incorporated for each term and all definitions, alternative terms, and synonyms such as contained in the Random House Webster's Unabridged Dictionary, second edition are hereby incorporated by reference. Finally, all references listed in the information disclosure statement or other information statement filed with the application are hereby appended and hereby incorporated by reference, however, as to each of the above, to the extent that such information or statements incorporated by reference might be considered inconsistent with the patenting of this/these invention(s) such statements are expressly not to be considered as made by the applicants. Exhibit A, in addition to any tables, is also incorporated herein by reference. Additionally, it should be noted that certain materials (e.g., a provisional application, which itself incorporates a 2004 report, and a 2005 report (Exhibit A)) are incorporated herein by reference. Where incorporated materials are inconsistent with text of the specification that has not been incorporated (such non-incorporated text may be considered "directly filed" text), the non-incorporated text of the specification shall take precedence over the incorporated text with which it is inconsistent.

Thus, the applicant(s) should be understood to have support to claim and make a statement of invention to at least: i) each of the cooling substances or the cooling apparatus as herein disclosed and described, ii) the related methods disclosed and described, iii) similar, equivalent, and even implicit variations of each of these devices and methods, iv) those alternative designs which accomplish each of the functions shown as are disclosed and described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) each system, method, and element shown or described as now applied to any specific field or devices mentioned, x) methods and apparatuses substantially as described hereinbefore and with reference to any of the accompanying examples, xi) the various combinations and permutations of each of the elements disclosed, and xii) each potentially dependent claim or concept as a dependency on each and every one of the independent claims or concepts presented.

With regard to claims whether now or later presented for examination, it should be understood that for practical reasons and so as to avoid great expansion of the examination burden, the applicant may at any time present only initial claims or perhaps only initial claims with only initial dependencies. Support should be understood to exist to the degree required under new matter laws—including but not limited to European Patent Convention Article 123(2) and United States Patent Law 35 USC 132 or other such laws—to permit the addition of any of the various dependencies or other elements presented under one independent claim or concept as dependencies or elements under any other independent claim or concept. In drafting any claims at any time whether in this application or in any subsequent application, it should also be understood that the applicant has intended to capture as full and broad a scope of coverage as legally available. To the extent that insubstantial substitutes are made, to the extent that the applicant did not in fact draft any claim so as to literally encompass any particular embodiment, and to the extent otherwise applicable, the applicant should not be understood to have in any way intended to or actually relinquished such coverage as the applicant simply may not have been able to anticipate all eventualities; one skilled in the art, should not be reasonably expected to have drafted a claim that would have literally encompassed such alternative embodiments.

Further, if or when used, the use of the transitional phrase "comprising" is used to maintain the "open-end" claims herein, according to traditional claim interpretation. Thus, unless the context requires otherwise, it should be understood that the term "comprise" or variations such as "comprises" or "comprising", are intended to imply the inclusion of a stated element or step or group of elements or steps but not the exclusion of any other element or step or group of elements or steps. Such terms should be interpreted in their most expansive form so as to afford the applicant the broadest coverage legally permissible.

Finally, any claims set forth at any time are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

What is claimed is:

1. A frozen environmental sample temperature control system comprising:

a frozen formulation, itself comprising:

water in an amount from substantially 87% to 78% by weight of said formulation, and salt in an amount from substantially 13% to 22% by weight of said formulation;

said system further comprising:

at least one container containing said frozen formulation; and a cooler having insulating material disposed between an outer wall and an inner surface that defines an inner chamber sized to contain therein said at least one container and at least one frozen environmental sample for transport, wherein said inner surface is configured to reduce conductive heat transfer to frozen contents of said cooler that are adjacent said inner surface.

2. A frozen environmental sample temperature control system as described in claim 1 wherein said inner surface is part of said insulating material.

3. A frozen environmental sample temperature control system as described in claim 1 wherein said cooler further comprises an inner wall that said inner surface is a part of.

4. A frozen environmental sample temperature control system as described in claim 3 wherein said inner wall has a reduced thickness as compared with that of conventionally used coolers.

5. A frozen environmental sample temperature control system as described in claim 4 wherein said inner wall has reduced mass as compared with that of conventionally used coolers.

6. A frozen environmental sample temperature control system as described in claim 1 wherein said inner surface is reflective.

7. A frozen environmental sample temperature control system as described in claim 6 wherein said inner surface comprises metallized Mylar film.

8. A frozen environmental sample temperature control system as described in claim 1 wherein said salt comprises NaCl.

9. A frozen environmental sample temperature control system as described in claim 8 wherein said salt further comprises KCl.

10. A frozen environmental sample temperature control system as described in claim 1 wherein said salt comprises only one type of salt.

11. A frozen environmental sample temperature control system as described in claim 1 wherein said frozen formulation further comprises a polymeric thickener.

12. A frozen environmental sample temperature control system as described in claim 1 wherein said inner surface is ribbed.

13. A frozen environmental sample temperature control system as described in claim 1 wherein said inner surface is pointed.

14. A frozen environmental sample temperature control system as described in claim 1 wherein said inner surface is holed.

15. A frozen environmental sample temperature control system as described in claim 1 wherein said inner surface is woven.

16. A frozen environmental sample temperature control system as described in claim 1 wherein said insulating material has a thickness greater than that of currently available foam insulating coolers.

17. A frozen environmental sample temperature control system as described in claim 16 wherein said insulating material has a thickness that is at least 10% greater than that of currently available foam insulating coolers used for cooled environmental sample shipping.

18. A frozen environmental sample temperature control system as described in claim 1 wherein said insulating material comprises polymeric foam.

19. A frozen environmental sample temperature control system as described in claim 18 wherein said polymeric foam is a foam selected from the group consisting of a thermosetting foam, a thermoplastic foam, and a elastomeric foam.

20. A frozen environmental sample temperature control system as described in claim 1 further comprising an on-board temperature data logger.

21. A frozen environmental sample temperature control system comprising:

a frozen formulation, itself comprising:

water in an amount from substantially 87% to 78% by weight of said formulation, and salt in an amount from substantially 13% to 22% by weight of said formulation;

said system further comprising:

at least one container containing said frozen formulation; and a cooler having insulating material disposed between an outer wall and an inner surface that defines an inner chamber sized to contain therein said at least one container and at least one frozen environmental sample for transport, wherein said insulating material comprises a silica based insulating material.

22. A frozen environmental sample temperature control system as described in claim 21 wherein said silica based insulating material comprises aerogel.

23. A frozen environmental sample temperature control system as described in claim 21 wherein said inner surface is part of said insulating material.

24. A frozen environmental sample temperature control system as described in claim 21 wherein said cooler further comprises an inner wall that said inner surface is a part of.

25. A frozen environmental sample temperature control system as described in claim 21 wherein said salt comprises NaCl.

26. A frozen environmental sample temperature control system as described in claim 25 wherein said salt further comprises a mixture of NaCl and KCl.

27. A frozen environmental sample temperature control system as described in claim 21 wherein said salt comprises only one type of salt.

28. A frozen environmental sample temperature control system as described in claim 21 wherein said frozen formulation further comprises a polymeric thickener.

29. A frozen environmental sample temperature control system as described in claim 21 further comprising an on-board temperature data logger.

30. A frozen environmental sample temperature control system comprising:

a frozen formulation, itself comprising:

water in an amount from substantially 87% to 78% by weight of said formulation; and salt in an amount from substantially 13% to 22% by weight of said formulation;

said system further comprising:

at least one container containing said frozen formulation; and a cooler having insulating material disposed between an outer wall and an inner surface that defines an inner chamber that is sized to contain said at least one container and at least one frozen environmental sample for transport, wherein said insulating material entirely surrounds said inner surface when said cooler is closed during shipping, and wherein said insulating material comprises a closed cell polymeric foam with a foam void volume to total foam volume ratio of greater than substantially 94%.

31. A frozen environmental sample temperature control system as described in claim 30 wherein said foam void volume to total foam volume ratio is greater than substantially 96%.

32. A frozen environmental sample temperature control system as described in claim 31 wherein said foam void volume to total foam volume ratio is greater than substantially 97%.

33. A frozen environmental sample temperature control system as described in claim 30 wherein said closed cell polymeric foam is a foam selected from the group consisting of a thermosetting foam, a thermoplastic foam, and an elastomeric foam.

34. A frozen environmental sample temperature control system as described in claim 30 wherein said closed cell polymeric foam is selected from the group of foams consisting of: polystyrene foam, polyurethane foam, ABS foam, ethylene vinyl acetate foam, polyethylene foam and polypropylene foam.

35. A frozen environmental sample temperature control system as described in claim 30 wherein closed cells of said closed cell polymeric foam are selected from the group consisting of air cells, carbon dioxide cells, CFC vapor cells, nitrogen cells, argon cells, helium cells, and evacuated cells.

36. A frozen environmental sample temperature control system as described in claim 30 further comprising an on-board temperature data logger.

37. A frozen environmental sample temperature control system comprising:

a frozen formulation, itself comprising:

water in an amount from substantially 87% to 78% by weight of said formulation; and salt in an amount from substantially 13% to 22% by weight of said formulation;

said system further comprising:

at least one container containing said frozen formulation; and a cooler having insulating material disposed between an outer wall and an inner surface that defines an inner chamber that is sized to contain said at least one container and at least one frozen environmental sample for transport, wherein said insulating material entirely surrounds said inner surface when said cooler is closed during shipping, and wherein said insulating material comprises an polymeric network with evacuated cells.

38. A frozen environmental sample temperature control system as described in claim 37 wherein said polymeric network has a network void volume to total network volume ratio of greater than substantially 94%.

39. A frozen environmental sample temperature control system as described in claim 37 wherein said polymeric network is selected from the group consisting of thermoplastic polymeric networks and thermosetting polymeric networks.

40. A frozen environmental sample temperature control system as described in claim 37 wherein said polymeric network is selected from the group consisting of: polystyrene network, polyurethane network, ABS network, ethylene vinyl acetate network, polyethylene network and polypropylene network.

41. A frozen environmental sample temperature control system as described in claim 37 further comprising an on-board temperature data logger.

42. A frozen environmental sample temperature control system as described in claim 37 wherein said polymeric network comprises a network selected from: ribbing, struts, honeycomb, and open cell.

* * * * *